United States Patent [19]

Willenbring

[11] 4,345,754

[45] Aug. 24, 1982

[54] PHOTOGRAPHIC STACKING DEVICE

[75] Inventor: Armer J. Willenbring, Bloomington, Minn.

[73] Assignee: Pako Corporation, Minneapolis, Minn.

[21] Appl. No.: 200,933

[22] Filed: Oct. 27, 1980

[51] Int. Cl.[3] ..... B65H 31/00

[52] U.S. Cl. ..... 271/209; 271/220

[58] Field of Search ..... 271/209, 220, 188

[56] References Cited

U.S. PATENT DOCUMENTS

| | | | |
|---|---|---|---|
| 2,944,813 | 7/1960 | Smith | 271/188 X |
| 3,224,760 | 12/1965 | Smith | 271/188 |
| 3,484,102 | 12/1969 | Von Arland et al. | 271/87 |
| 3,556,513 | 1/1971 | Howard | 271/4 |
| 3,632,107 | 1/1972 | Rehm | 271/220 |
| 3,658,323 | 4/1972 | Matwey | 271/86 |
| 4,019,640 | 4/1977 | Marin | 271/209 X |
| 4,114,349 | 9/1978 | Jensen et al. | 53/54 |
| 4,313,669 | 2/1982 | Larson et al. | 354/354 |

FOREIGN PATENT DOCUMENTS

| | | | |
|---|---|---|---|
| 2822827 | 11/1978 | Fed. Rep. of Germany | 271/188 |
| 789015 | 1/1958 | United Kingdom . | |

OTHER PUBLICATIONS

Roger M. Swanson, "Self-Centering Paper Tray," *Xerox Disclosure Journal,* vol. 11, Numbers 9/10, Sep.-/Oct. 1976.

*Primary Examiner*—Richard A. Schacher

*Attorney, Agent, or Firm*—Kinney, Lange, Braddock, Westman and Fairbairn

[57] ABSTRACT

An improved photographic print stacking device includes a print slide concavely bowed transversely to the direction of travel proximate a discharge end of a conveying line, and a pair of drive rollers. Individual photographic prints are conveyed on the conveying line onto the concavely bowed print slide. The drive rollers engage and push the central portion of each print downwardly against the central portion of the print slide, while the slide edge portions of each print are deflected upwardly by the side edges of of print slide so that each print is bowed, thereby giving each print greater beam strength in the direction of travel.

3 Claims, 2 Drawing Figures

PHOTOGRAPHIC STACKING DEVICE

REFERENCE TO COPENDING APPLICATION

Reference is made to a copending application by Louis A. Larson and Charles L. Euteneuer entitled "Photographic Print Stacking Tray Device" which has issued as U.S. Pat. No. 4,313,669 on Feb. 2, 1982 and was filed on even date, Oct. 27, 1980, with this application and is assigned to the same assignee.

BACKGROUND OF THE INVENTION

1. Field of the Invention

The present invention relates to photographic print stacking devices.

2. Description of the Prior Art

In the past, efforts have been made to produce high-speed automatic, sorting, conveying and stacking equipment to expedite the packaging of photographic prints. One advantageous system is the Pako Photopacker system in which photographic prints are cut, sorted, conveyed, stacked and inserted into a package on a fully automated basis. This system is illustrated in the Jensen et al U.S. Pat. No. 4,114,349 entitled "Automatic Sorting, Conveying and Packaging Mechanism for Photographic Prints", which is assigned to the same assignee as the present application.

SUMMARY OF THE INVENTION

The present invention provides an improvement in high-speed automatic stacking of individual photographic prints. The photographic print stacking device includes a print slide concavely bowed transversely to the direction of travel proximate the discharge end of a conveying line, and a pair of drive rollers. Individual photographic prints are conveyed on the conveying line to the concavely bowed pring slide. The pair of drive rollers engage and push downwardly the central portion of each print against the central portion of the print slide, while the side edge portions of each print are deflected upwardly by edge portions of the print slide forming a concave bow in the print. The pair of drive rollers and the concavely bowed print slide discharge each print concavely bowed with greater beam strength in the direction of travel of the print.

DETAILED DESCRIPTION OF THE PREFERRED EMBODIMENT

The high speed prior art print stacking system shown in the aforementioned Jensen et al patent has worked well in conveying and stacking individual photographic prints in the United States. However, it has been found that prints in other countries (in particular in Europe) tend to buckle as they are stacked on a print tray, resulting in jamming. It is believed that the buckling of photographic prints occurs when a leading edge of a print discharged from a conveying system slides along top of a trailing portion of a previous print stacked onto the print tray with static forces holding the two print portions together. The trailing portion of the discharging print, however, continues in a downward and forward direction, buckling the photographic print in the transverse direction and jamming the photographic print stacking tray.

It has been discovered that the tendency of photographic prints to buckle in other countries appears to be due to the thinness of the print paper used. The thin print paper used in Europe has less rididity in the direction of travel of the prints (i.e. the "machine direction") and therefore has a greater tendency to buckle in a high speed photographic print stacker.

Figure 2:
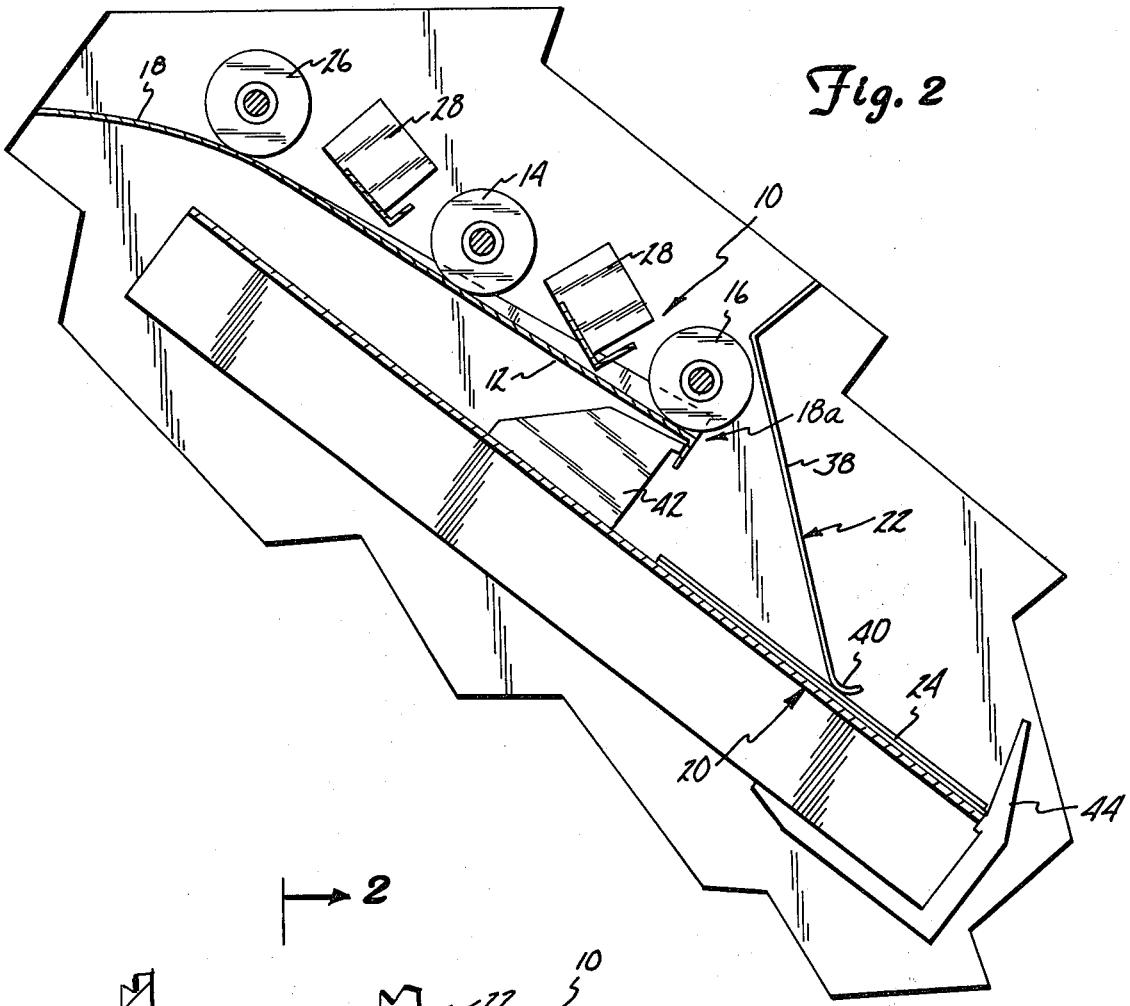
FIG. 2 is a diagrammatical view of the photographic print stacking device of the present invention taken generally along the line 2—2 of FIG. 2, with portions not shown for purposes of clarity.
Figure 1:
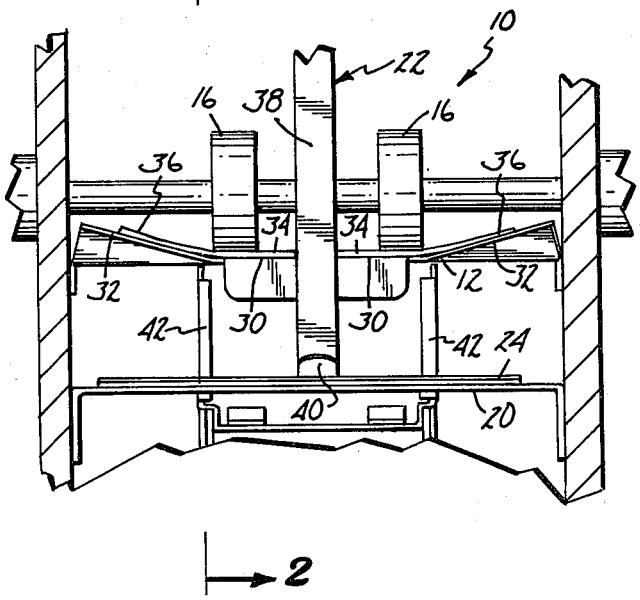
FIG. 1 is a front elevational view of the photographic print stacking device of the present invention.

An improved print stacking device 10 of the present invention is illustrated in FIGS. 1 and 2. Print stacking device 10 includes a print slide 12 and a plurality of drive rollers 14, 16. Print stacking device 10 is proximate discharge end 18*a* of a high-speed automatic photographic conveying line 18. A photographic print stacking tray 20 is mounted generally below discharge end 18*a* for receiving photographic prints being discharged therefrom. Central deflector 22 deflects the photographic prints downwardly onto print tray 20 which holds each print in a stack of prints 24.

Conveying line 18 has a plurality of drive rollers 26 and a plurality of guides 28. Drive rollers 26 convey each photographic print along conveying line 18 while guides 28 prevent the photographic prints from leaving conveying line 18.

Print slide 12, as best seen in FIG. 1, is concavely bowed transversely to the direction of travel of the photographic prints. Print slide 12 preferably has a substantially flat central portion 30 and edge portions 32 which slope downwardly and inwardly toward central portion 30. Drive rollers 14, 16 preferably engage central flat portion 30. The bowed configuration of print slide 20 increases gradually from conveying line 18 to discharge end 18*a*.

As the photographic prints leave conveying line 18 and approach concavely bowed print slide 12, drive rollers 14 and 16 engage central portion 34 of each photographic print and push it downwardly against central portion 30 of print slide 12. As central portion 34 of each photographic print is pushed downwardly against central portion 30 of print slide 12, edge portions 36 of each photographic print deflect upwardly by engaging inclined side portions 32 of print slide 12. The gradual increase in bow of the print slide 20 permits a gradual bowing of each photographic print. The generally concavely bowed configuration of print slide 12, concavely bowing each individual photographic print, imparts a greater beam strength in the print in the directon of travel of the print.

After each print is discharged by print stacking device 10, central deflector 22 deflects the print downwardly onto print tray 20. Central deflector 22 preferably is a hold-down leaf spring having an upper portion 38 for initially engaging the photographic prints and a lower portion 40 for holding the prints in a print stack 24.

Print tray 20 also includes a print ejector element 42 for engaging the stack of prints 24 at the end of an order and thus ejecting the print stack 24 off tray 20 and into a packaging envelope (not shown). Print stop 44 stops each photographic print on print stack 24. Print stop 44 is pivotally connected below print tray 20 and is pivoted out of the discharge path of print stack 24 when being ejected by ejector element 42.

Photographic print stacking device 10 preferably is used to collect the good prints in an automatic sorting, conveying and packing mechanism like that in the previously-mentioned Jensen et al patent. Device 10 minimizes jamming of photographic prints by concavely bowing each individual photographic print as it is being discharged from the conveying line 18. Since the concave bow is transverse to the direction of travel of the prints, a rigidity or beam strength is added to the photographic prints which is sufficient to overcome any tendency to buckle during the stacking process on print tray 20.

Although the present invention has been described with reference to the preferred embodiments, persons skilled in the art will recognize that changes may be made in form and detail without departing from the spirit and scope of the invention.

What is claimed is:

1. A photographic print stacking device for stacking individual photographic prints, each print having an image-bearing surface and a non-image-bearing surface, on a print tray as they are discharged in a machine direction from a discharge end of a print conveying apparatus, the device comprising:

a print slide positioned proximate the discharge end and generally above a print tray for receiving and discharging individual photographic prints with the non-image-bearing surface adjacent the print slide as the prints are driven in the machine direction, the print slide having a substantially flat central portion and a pair of downwardly and inwardly sloping side portions, sloping toward the central portion of such that the print slide has a concavely bowed surface in a transverse direction for engaging the prints and having a print slide discharge end;

drive roller means for drivably engaging a central portion of the image-bearing surface of each photographic print for discharging each print off the print slide, the drive roller means being positioned above the substantially flat central portion of the print slide proximate the print slide discharge end to cause the prints to generally conform to the concave bow of the print slide in a transverse direction by deflecting side portions of each print upwardly with the side portions of the print slide as each print is discharged from the discharge end of the print conveying apparatus; and a central deflector downwardly deflecting each print toward the print tray onto a print stack after each print is discharged from the print slide, the central deflector having an upper end portion attached proximate the print conveying apparatus and positioned proximate the print slide discharge end to deflect each print upon discharge from the print slide.

2. The device of claim 1 wherein the central deflector is a hold-down leaf spring.

3. A method for stacking individual photographic prints having an image-bearing surface and a non-image-bearing surface, the method comprising:

conveying each individual photographic print with the image-bearing surface up from a print conveying apparatus to a print slide on a top surface of the print slide which is concavely bowed in a direction transverse to the direction of travel of the prints;

bowing each individual photographic print with drive roller means engaging the image-bearing surface of each print to cause the print to conform generally to the concavely bowed top surface of the print slide;

discharging each individual photographic print from the print slide with the drive roller means; and deflecting each photographic print downwardly for stacking onto a tray.

* * * * *